US007043763B2

(12) United States Patent
Carrillo

(10) Patent No.: US 7,043,763 B2
(45) Date of Patent: May 16, 2006

(54) PNEUMATIC DEVICE FOR BOXING GLOVES TO REDUCE HEAD TRAUMA

(76) Inventor: Hipolito Carrillo, P.O. Box 404, Guaynabo, PR (US) 00970

( * ) Notice: Subject to any disclaimer, the term of this patent is extended or adjusted under 35 U.S.C. 154(b) by 308 days.

(21) Appl. No.: 10/660,663

(22) Filed: Sep. 12, 2003

(65) Prior Publication Data

US 2005/0055752 A1 Mar. 17, 2005

(51) Int. Cl.
*A41D 13/08* (2006.01)

(52) U.S. Cl. ..... 2/18; 2/161.1

(58) Field of Classification Search ..... 2/18, 2/411, 412, 413, 414, 16, 20, 159, 161.1; 446/267; D29/116
See application file for complete search history.

(56) References Cited

U.S. PATENT DOCUMENTS

| | | | | | |
|---|---|---|---|---|---|
| 531,872 | A | * | 1/1895 | Shibe | 2/18 |
| 1,054,832 | A | | 3/1913 | Dunn | |
| 2,135,853 | A | * | 11/1938 | Slizus et al. | 2/18 |
| 2,275,206 | A | | 3/1942 | Sutherland | |
| 2,740,120 | A | * | 4/1956 | Temple | 2/18 |
| 2,817,088 | A | * | 12/1957 | Vrana | 2/18 |
| 2,826,757 | A | * | 3/1958 | Vrana | 2/18 |
| 2,881,445 | A | * | 4/1959 | Vrana | 2/18 |
| 2,881,446 | A | * | 4/1959 | Vrana | 2/18 |
| 3,217,333 | A | | 11/1965 | Sweet et al. | |
| 3,247,520 | A | | 4/1966 | Slizus | |
| 3,487,417 | A | * | 12/1969 | Morgan | 2/413 |
| 5,427,577 | A | * | 6/1995 | Picchietti et al. | 473/59 |
| 5,502,841 | A | | 4/1996 | Stanford | |
| 5,537,688 | A | * | 7/1996 | Reynolds et al. | 2/20 |
| 5,603,118 | A | * | 2/1997 | Solomon | 2/20 |
| 5,723,786 | A | | 3/1998 | Klapman | |
| 5,845,417 | A | | 12/1998 | Reed et al. | |
| 6,014,770 | A | * | 1/2000 | Spector | 2/18 |
| 6,351,854 | B1 | | 3/2002 | Whalen et al. | |

FOREIGN PATENT DOCUMENTS

| | | |
|---|---|---|
| WO | WO 99/66810 | 12/1999 |

* cited by examiner

*Primary Examiner*—Gary L. Welch
(74) *Attorney, Agent, or Firm*—Richard C. Litman

(57) ABSTRACT

A pneumatic device that is inserted in a boxing glove, which device is effective to reduce trauma to the body of a person receiving the blow, especially a blow to the head. The device is attached inside the boxing glove adjacent the impact area and function to decrease the energy of impact from the boxer's fist, thus reducing the occurrence of trauma, especially to the head and brain.

10 Claims, 3 Drawing Sheets

PNEUMATIC DEVICE FOR BOXING GLOVES TO REDUCE HEAD TRAUMA

BACKGROUND OF THE INVENTION

1. Field of the Invention

The present invention generally relates to sports equipment. More specifically, the present invention is drawn to boxing gloves having a pneumatic device therein for reducing head trauma.

2. Description of the Related Art

The stereotype of the punch-drunk boxer is not so far-fetched in that we often see retired boxers who are disabled, to various degrees, as a result of repeated blows to the head. One of the all-time great heavyweight champions is believed to be disabled because of receiving such blows. Too often deaths occur to boxers because of the devastating head trauma received in a boxing match. A device that would lessen the trauma without diminishing the excitement and skill of the sport, would certainly be a welcome addition to the art.

There are many devices in the related art designed to add pneumatic padding to boxing gloves. For example, U.S. Pat. No. 1,054,832 (Dunn), U.S. Pat. No. 2,275,206 (Sutherland), U.S. Pat. No. 3,217,333 (Sweet et al.), U.S. Pat. No. 3,247,520 (Slizus) and WO 99/66810 disclose pneumatically padded boxing gloves. It is noted, however, that the gloves have no means to release air at the moment of impact and to take in air instantaneously thereafter.

U.S. Pat. No. 5,723,786 (Klapman) is drawn to a system for measuring the impact of a boxing glove. The patentee does not contemplate providing structure to lessen the effect of such impact.

U.S. Pat. No. 6,351,854 B1 (Whalen et al.) discloses a personal protective device that employs a fluid reservoir to receive a fluid from a resilient protective bag.

U.S. Pat. No. 5,502,841 (Stanford) shows a boxing glove which utilizes an elastic band and plate to reduce the impact of a punch.

U.S. Pat. No. 5,845,417 (Reed et al.) discloses structure for ventilating a shoe.

None of the above inventions and patents, taken either singly or in combination, is seen to disclose a pneumatic boxing glove as will subsequently be described and claimed in the instant invention.

SUMMARY OF THE INVENTION

The instant invention is drawn to a pneumatic device that is inserted in a boxing glove, which device is effective to reduce trauma to the body of a person receiving the blow. This is especially important when receiving a blow to the head.

Medical research has shown that the brain structure cannot withstand G forces of more than 4–5 without exhibiting signs of neurological dysfunction. The impact of a professional boxer's top punch is estimated to generate a G force of between 4 and 4.5, which is enough to inflict serious damage to the brain tissue. The device of the instant invention will be attached inside the boxing glove at the impact area and function to decrease the energy of impact from the boxer's fist, thus reducing the occurrence of trauma, especially to the head and brain.

The device will have an approximate area proportional to the length of the metacarpal bones with a width determined by the length of the proximal phalanx of the hand. In most cases this will yield an approximate length of four inches and an approximate width of two inches (area of eight square inches). Of course these dimensions may vary slightly from person to person. The device employs a pneumatic system, which system automatically releases air on impact (compression) and takes in air when the forces of the impact have been removed. As contemplated, the device will have a recovery time of one second or less after compression. Although indicated for a boxing glove, it is apparent that the device could be adapted for other sport devices.

Accordingly, it is a principal object of the invention to provide a boxing glove, which boxing glove reduces the occurrence of severe trauma.

It is a further object of the invention to provide a boxing glove, which boxing glove reduces the occurrence of severe trauma especially to the head and brain.

It is another object of the invention to provide a boxing glove, which boxing glove employs a pneumatic system for reducing the effect impact from a boxer's fist.

Still another object of the invention is to provide a boxing glove, which boxing glove utilizes ambient air in a pneumatic system for reducing the effect impact from a boxer's fist.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
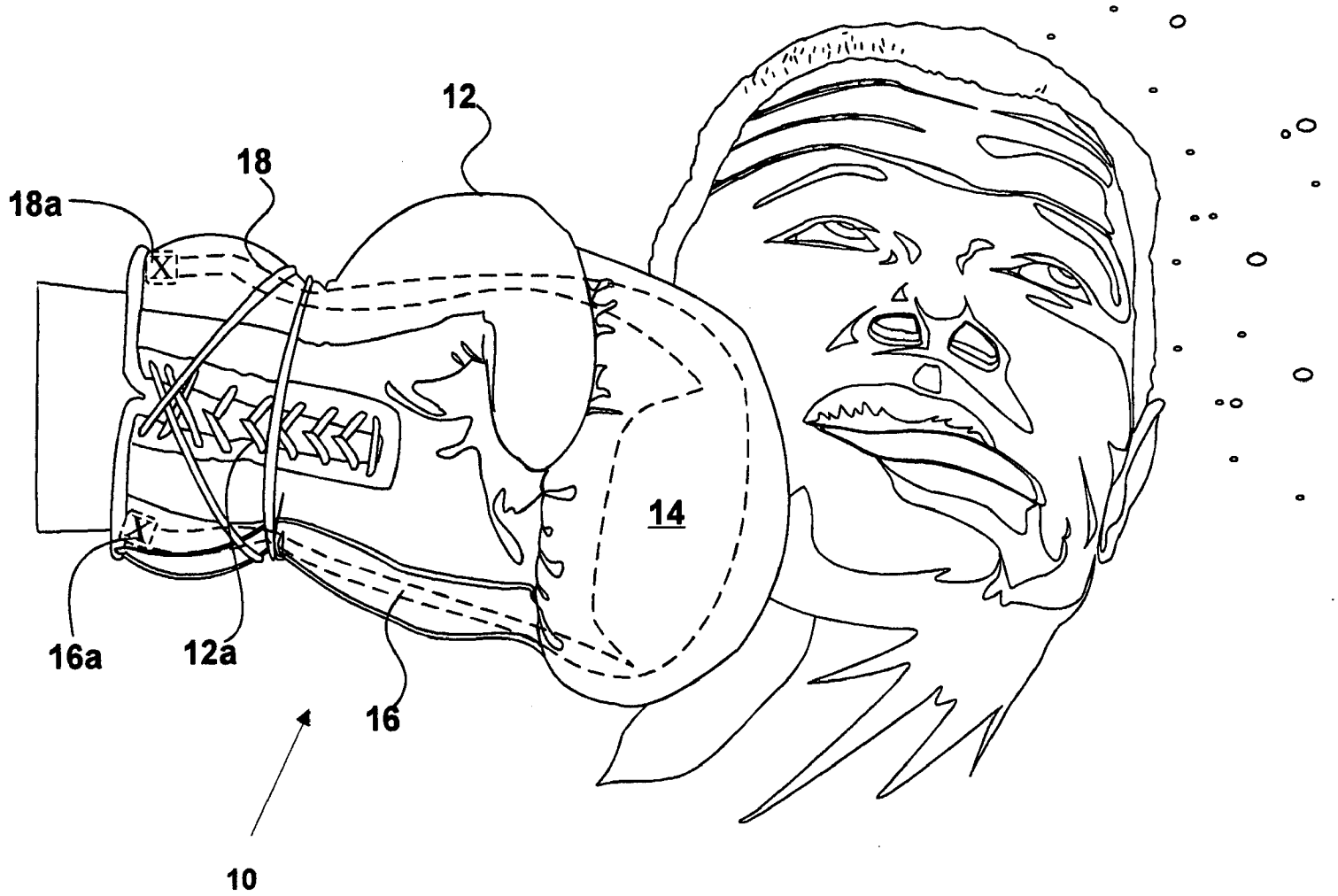
FIG. 1 is an environmental, perspective view of a pneumatic device for boxing gloves to reduce head trauma according to the present invention.
Figure 2:
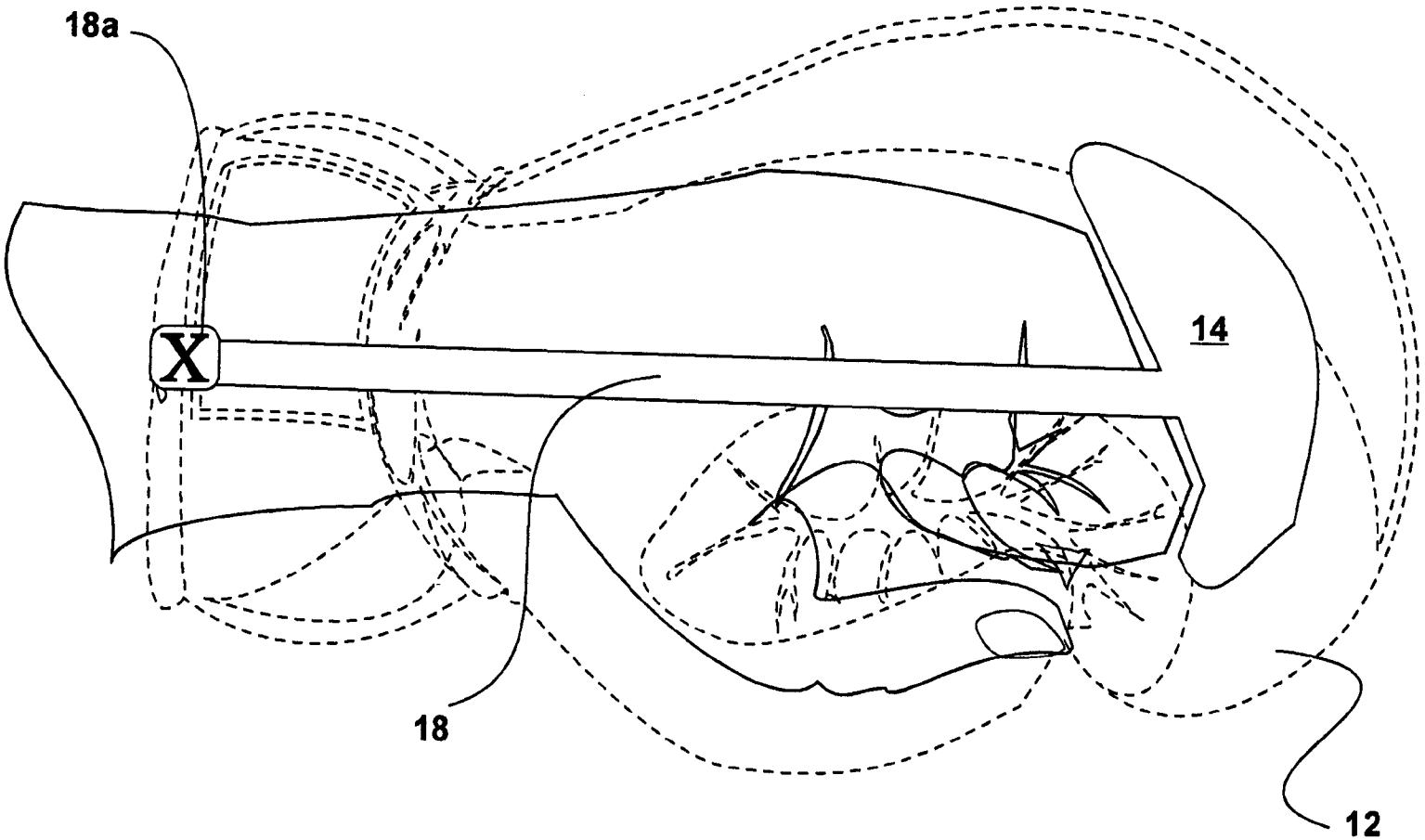
FIG. 2 is a side view of a pneumatic device for boxing gloves to reduce head trauma according to the present invention.
Figure 3:
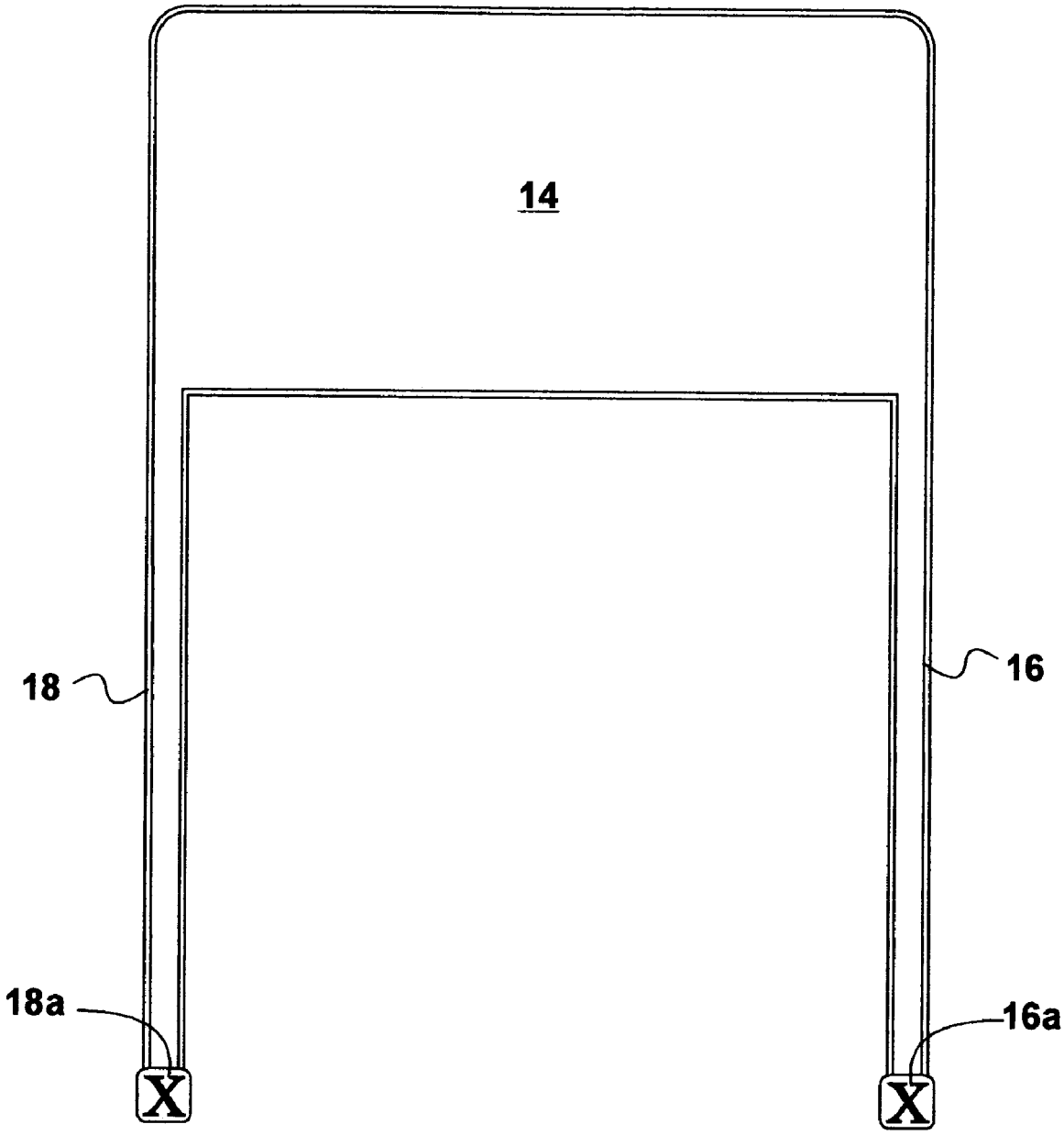
FIG. 3 is a top view of a pneumatic device for boxing gloves to reduce head trauma according to the present invention.

Attention is directed to FIG. 1 wherein the pneumatic device of the instant invention is generally indicated at 10. The device is disposed in a boxing glove 12 having the usual laces 12*a* incorporated therein. As best seen in FIGS. 2 and 3 the pneumatic device comprises an open cell foam member 14 fabricated from natural rubber and having the ability, in an uncompressed state, to absorb air. When compressed air will be expelled from member 14. Member 14 is disposed in glove 12 such that the member is positioned adjacent the impact area of the glove. Conduits 16 and 18 are in fluid (air) communication with member 14. Conduits 16 and 18 open into ambient atmosphere adjacent the wrist portion of glove 12. Conduits 16 and 18 terminate in respective valves 16*a* and 18*a*. The valves, however may be disposed at other positions in the conduits. Valve 16*a* is an adjustable pressure release valve. Valve 18*a* is an intake valve. Member 14 and conduits 16, 18 are disposed in conventional padding. As discussed above, member 14 is designed to cover the metacarpal area of the clinched fist and will have an area of approximately eight square inches. Release valve 16*a* is calibrated to open if the pressure (in psi) produced by the impact of a punch is comparable to a G force of 2. As contemplated, this calibration will be determined by the weight of the boxer. This arrangement prevents the G forces transmitted at impact from ever attaining G forces that could cause brain damage. Upon release of the compressive forces due to impact, intake valve 18*a* will open to allow air to drawn into member 14.

It is to be understood that the present invention is not limited to the embodiment described above, but encompasses any and all embodiments within the scope of the following claims.

I claim:

1. A boxing glove adapted to reduce head trauma, comprising:

a glove body, said glove body having an inner volume and an outer surface, said outer surface having an impact area;

a device for reducing the force of a blow transmitted at impact, said device including a fluid absorbent, compressible material, said material disposed adjacent said impact area and in said inner volume of said glove body;

wherein said material maintains a predefined shape when in an uncompressed state;

a first conduit having a proximate end in fluid communication with said material and a distal end opening into ambient atmosphere;

a first unidirectional valve coupled to said first conduit;

a second conduit having a proximate end in fluid communication with said material and a distal end opening into ambient atmosphere;

a second unidirectional valve coupled to said second conduit.

2. A boxing glove adapted to reduce head trauma according to claim 1, wherein said glove has a wrist area and said first conduit opens into ambient at said wrist area.

3. A boxing glove adapted to reduce head trauma according to claim 1, wherein said glove has a wrist area and said second conduit opens into ambient at said wrist area.

4. A boxing glove adapted to reduce head trauma according to claim 1, wherein said first unidirectional valve is an intake valve.

5. A boxing glove adapted to reduce head trauma according to claim 1, wherein said second unidirectional valve is a pressure release valve.

6. A boxing glove adapted to reduce head trauma according to claim 1, wherein said material is a rubberized foam material.

7. A boxing glove adapted to reduce head trauma, comprising:

a glove body, said glove body having an inner volume, an outer surface and a wrist area, said outer surface having an impact area;

a device for reducing the force of a blow transmitted at impact, said device including a fluid absorbent, compressible, material, said material disposed adjacent said impact area and in said inner volume of said glove body;

a first conduit having a proximate end in fluid communication with said material and a distal end opening into ambient atmosphere at said wrist area, said first conduit including an intake valve positioned therein; and a second conduit having a proximate end in fluid communication with said material and a distal end opening into ambient atmosphere at said wrist area, said second conduit including a pressure release valve positioned therein.

8. A boxing glove adapted to reduce head trauma according to claim 7, wherein said material is a rubberized foam material.

9. A boxing glove adapted to reduce head trauma, comprising:

a glove body, said glove body having an inner volume and an outer surface, said outer surface having an impact area;

an inflatable device formed of a resilient material, said resilient material having a predetermined shape defining an internal volume, said predetermined shape of said resilient material being compressible;

wherein said resilient material maintaining said shape when in an uncompressed state;

a first conduit having a proximate end in fluid communication with said material and a distal end in communication with ambient atmosphere; and a second conduit having a proximate end in fluid communication with said material and a distal end in communication with ambient atmosphere;

a first unidirectional fluid valve being disposed at the distal end of said first conduit, said first unidirectional valve allowing ambient atmosphere into said first conduit;

a second unidirectional fluid valve being disposed at the distal end of said second conduit, said second unidirectional valve allowing fluid to pass from said second conduit into the ambient atmosphere;

said second unidirectional valve having a predetermined operational pressure threshold;

wherein said second unidirectional valve releases fluid upon said predetermined operational threshold is reached whereby a reduction in the force of a blow transmitted at impact of said glove body by expelling fluid via said second unidirectional valve upon compression of said inflatable device, and said inflatable device restoring said predetermined shape upon removal of said compression, causing a fluid intake via said first unidirectional valve.

10. A boxing glove adapted to reduce head trauma according to claim 9, wherein said second unidirectional valve is a pressure release valve positioned at said distal end of said second conduit.

* * * * *